US006658701B1

(12) United States Patent
DeHart et al.

(10) Patent No.: US 6,658,701 B1
(45) Date of Patent: Dec. 9, 2003

(54) DETACHABLE HANDLE FOR CONTAINERS

(76) Inventors: Damon H. DeHart, 34 Putnam Rd., Bedford, MA (US) 01730; Allan R. Tate, 12 Putnam Rd., Bedford, MA (US) 01730

( * ) Notice: Subject to any disclaimer, the term of this patent is extended or adjusted under 35 U.S.C. 154(b) by 0 days.

(21) Appl. No.: 10/063,251

(22) Filed: Apr. 3, 2002

(51) Int. Cl.[7] ..... A45C 13/22

(52) U.S. Cl. ..... 16/425; 16/422; 16/DIG. 12; 294/27.1; 294/31.1; 220/759

(58) Field of Search ..... 16/425, 422, DIG. 12, 16/DIG. 19; 294/27.1, 31.1, 32; 220/758, 759, 764, 769

(56) References Cited

U.S. PATENT DOCUMENTS 2,029,429 A * 2/1936 Koons ..... 294/33
2,639,502 A * 5/1953 Wormelle, Jr. ..... 30/450
2,648,900 A * 8/1953 Anderson ..... 30/450
3,304,112 A * 2/1967 Elliot ..... 294/34
5,203,471 A * 4/1993 Widman ..... 220/755
5,377,863 A * 1/1995 Widman ..... 220/696
6,266,849 B1 * 7/2001 Petit et al. ..... 16/425

FOREIGN PATENT DOCUMENTS

GB 2116835 A * 10/1983
GB 2182906 A * 5/1987

* cited by examiner

*Primary Examiner*—Chuck Y. Mah
(74) *Attorney, Agent, or Firm*—Mark P. White

(57) ABSTRACT

A detachable handle for securely holding and lifting a container, such as a paint can which has a lid-receiving channel at the top of the container, is formed as an integral unit of injection molded compliant material. It includes a grip, an upper heel contacting the container inside wall at an upper position, and a lower heel contacting the container outside wall at a lower position. The handle also includes a lift point contacting the lid-receiving channel underside, and a middle arm contacting the top of the lid-receiving channel above the lift point, providing vertical stability, and allows the user to hold or lift the container without risk of tipping or spilling. The handle is easily applied or removed by contacting the lower heel against the outside wall and rotating the handle into place.

18 Claims, 7 Drawing Sheets

DETACHABLE HANDLE FOR CONTAINERS

BACKGROUND OF INVENTION

The prior art is replete with handles to be used with paint cans and similar containers, and many of these, such as U.S. Pat. No. 280,274, were filed in the nineteenth century. Much of the prior art also operates in a manner similar to the current invention, by gripping the edge of the container, together with other means for securing the container to the handle.

U.S. Pat. No. 2,320,262, like the current invention, grips the channel at the top of the can used to secure the lid, doing so at several points. However, '262 is made of multiple parts, which require active manipulation, rather than being an integrated unit, in contrast to the current invention. U.S. Pat. No. 2,493,751 also grips the lid channel, doing so at a single point, and compressing the channel against the side wall of the container in order to secure the handle. U.S. Pat. No. 2,493,751, however, does not provide a separate element to prevent the handle from rotating upward about the lid channel, and the description provided does not indicate that any means are provided to do so.

The present invention is an improvement on the prior art in several ways. First, it is extremely simple and inexpensive to manufacture, as it is formed as an integrated article of manufacture formed from a single sheet of material. It may be cut or stamped from a sheet of material, or injection molded. In either case, it is fabricated from a compliant, plastic material. Second, it contains a number of elements which, taken together, grip the container securely despite the substantial weight of the container when full of a heavy liquid such as paint. And thirdly, it is easily attached and detached from the container.

SUMMARY OF INVENTION

It is an object of the present invention to provide a handle for securely holding containers, such as paint cans, facilitating their ease of use. It is a further object of the invention to provide a simplified handle which is inexpensive to manufacture, and easy to use.

In accordance with a first aspect of the invention, the handle is affixed to the can by rotating about a center of rotation in a direction of first angular rotation, and removed by rotating in a direction opposite to the first angular rotation.

In accordance with a second aspect of the invention, the container is horizontally stabilized by locating an upper heel and a lower heel on opposite sides of the paint can side wall.

In accordance with a third aspect of the invention, the container is vertically stabilized by capturing the container lid channel between an upper arm and a middle arm of the handle.

In accordance with a fourth aspect of the invention, a detent in the middle arm captures an inner or outer edge of the lid channel.

In accordance with a fifth aspect of the invention, an upper grip is located over the approximate center of gravity of the container when the handle is in place.

In accordance with a sixth aspect of the invention, a lower grip is located so that the user grips the handle at the side of the container .

In accordance with a final aspect of the invention, the handle further contains a pry tip for use in prying the lid from the container and a ladder hook used to suspend the can while painting.

BRIEF DESCRIPTION OF DRAWINGS

These, and further features of the invention, may be better understood with reference to the accompanying specification and drawings depicting the preferred embodiment, in which.

DETAILED DESCRIPTION

First Embodiment

Figure 1:
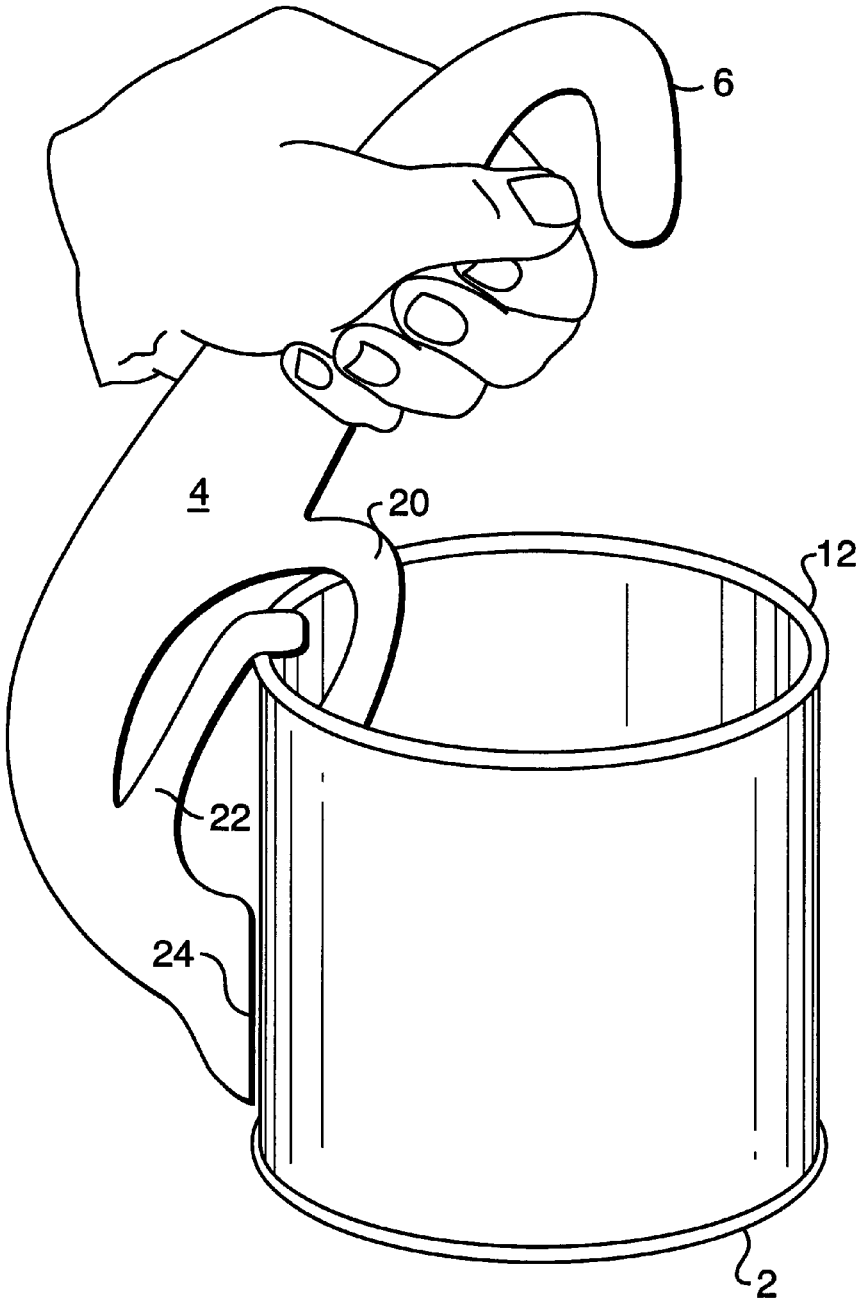
FIG. 1 depicts a perspective view of a user, holding a paint can using one of the preferred embodiments of the invention.

The first embodiment of the present invention is shown in FIG. 1, supporting a paint can 2. The handle in this embodiment is injection molded from polypropylene plastic. It is a substantially planar article of manufacture, in that the cross section perpendicular to the drawing of FIG. 1 is a thin rectangle. In other words, the handle has a uniform thickness throughout. Other materials appropriate for this use include polyester, nylon and others.

The handle has an elongated body that serves as a grip. It is noted that the shape of the body is such that the user grips the handle above to the center of gravity of the paint can. At the extreme upper end of the handle is a ladder hook, used to suspend the handle while painting. Because this hook is located approximately above the center of gravity of the can, it may safely be used to suspend the paint can while painting, without support from the user.

Figure 2:
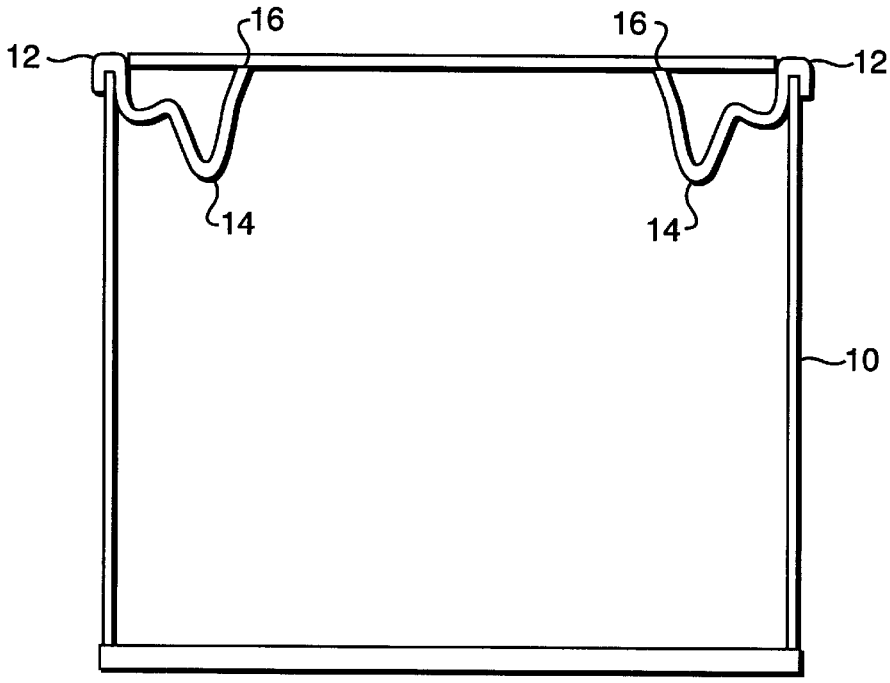
FIG. 2 depicts a side elevation view of a paint can having a lid channel.

The paint can itself is seen in cross-section view in FIG. 2. The can has side wall 10, and an outer rim 12, which is integrally formed into a lid channel 14, and an inner rim 16, the paint lid pressed into the lid channel between the outer and inner rims when the paint can is stored.

Figure 3:
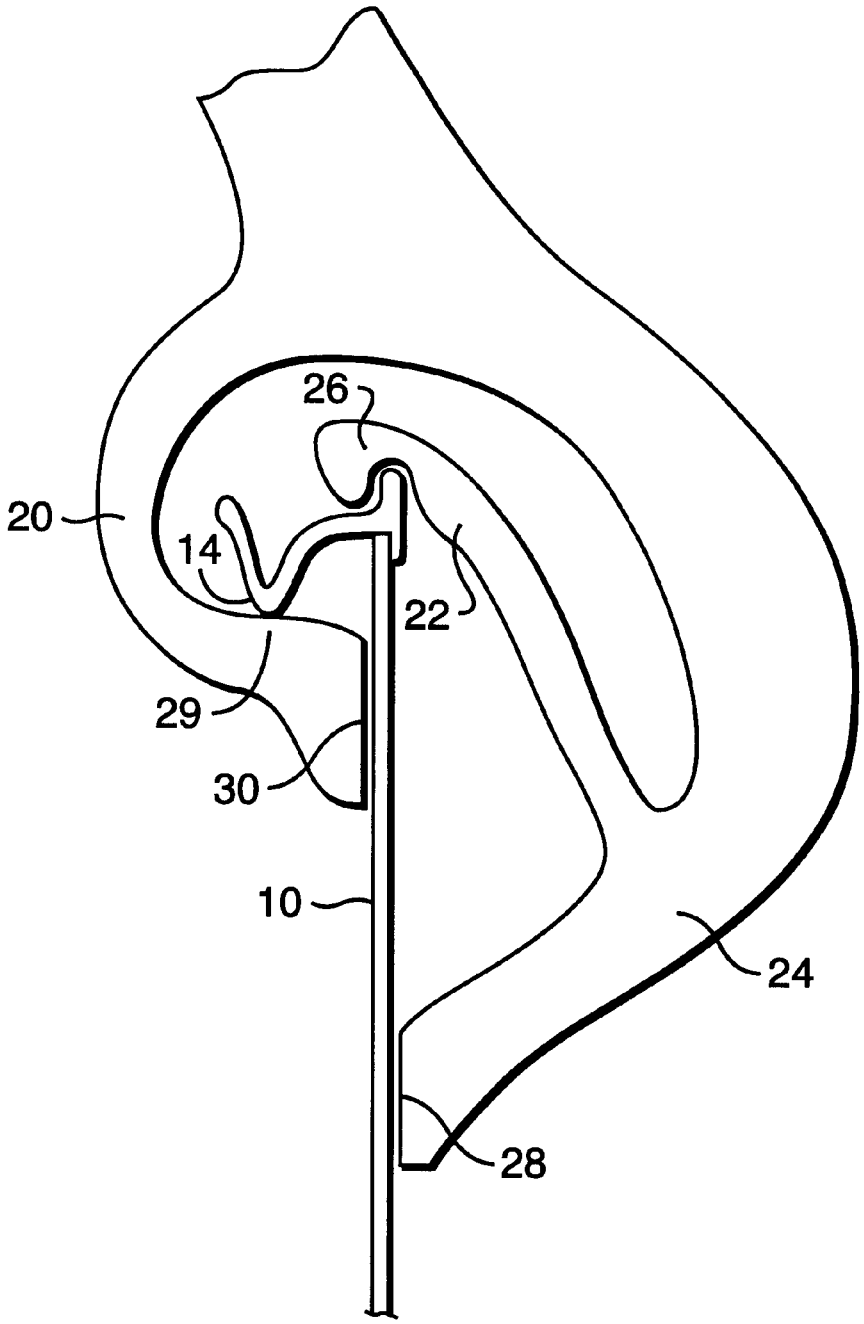
FIG. 3 depicts a side elevation view of part of one of the preferred embodiment of the invention.
Figure 4:
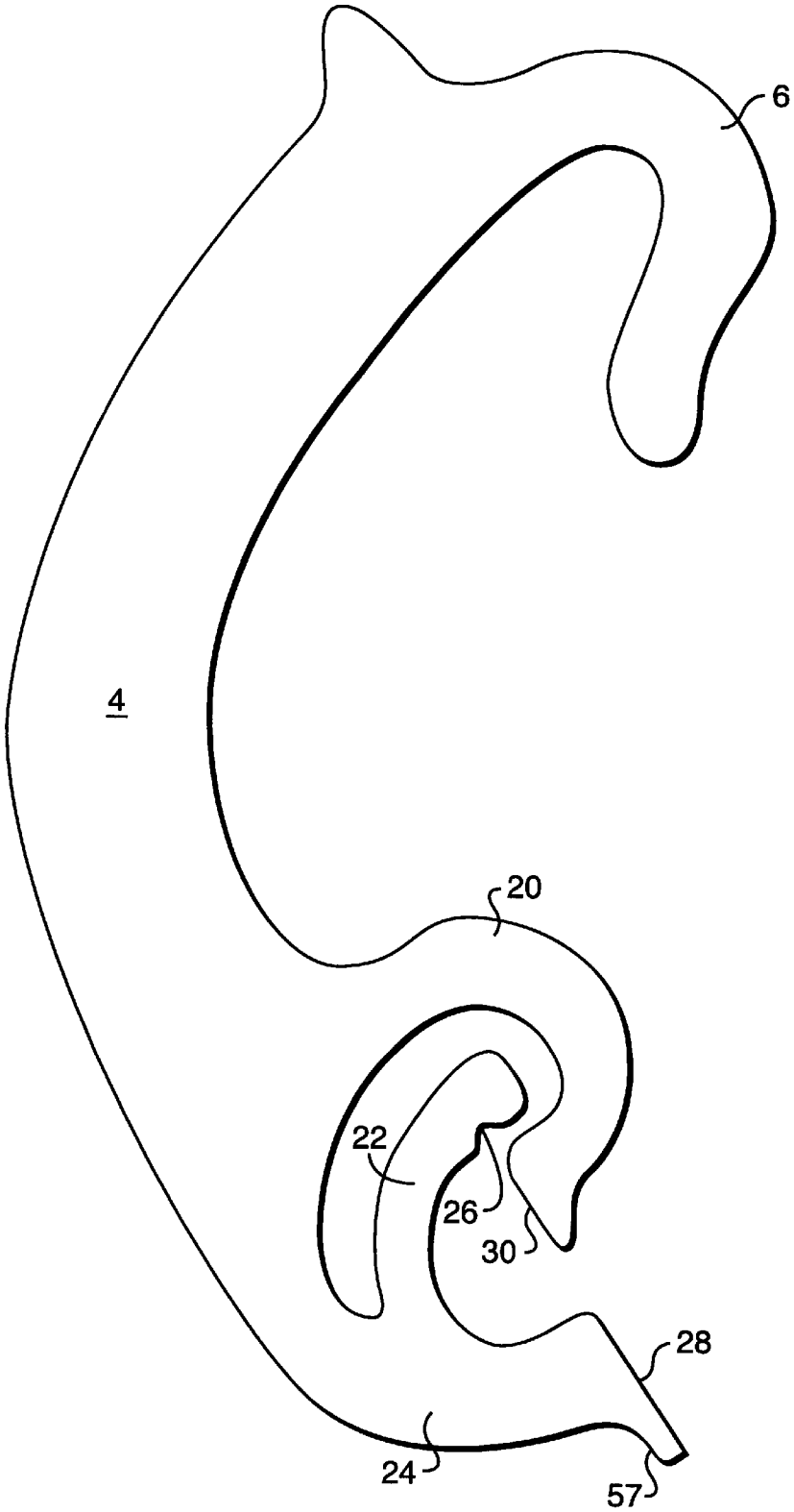
FIG. 4 depicts a side elevation view of an alternative embodiment of the invention.

Referring now to FIG. 3, which shows a side elevation view of the bottom portion of the handle of FIG. 4 inserted into the paint can, the lower arm 24 is seen to terminate in a lower heel 28 that presses against the outside wall 10 of the paint can. The middle arm 22 terminates in a process containing a detent 26, which engages the outer rim of the paint can, securing it place, pressing downward. This arm which contains a detent is also referred to as a "detent arm". Note that the detent in this embodiment engages the lid channel where it meets the side wall of the can. The detent location can be adjusted to engage the lid channel at a number of different points, depending upon the geometry of the particular embodiment chosen.

A lift point 29 located in the upper arm 20 engages the bottom of the lid channel 14, transmitting an upper force on the paint can when the handle is used to lift it. The member which contains a lift point is also referred to as a "lift member". This upward force counters the downward pressure of the detent 26, stabilizing the paint can in a vertical position. Lower heel 28 further engages the handle to the paint can, creating further stability. As seen in FIG. 1, the middle arm 22 is pressed upwards when the handle is in place, and because of the compliant nature of the plastic, exerts a restoring pressure against the outer rim 12 of paint can.

Still referring to FIG. 3, the handle is affixed to the paint can by first inserting the upper heel 30 within the paint can, and rotating the handle about the upper heel in a clockwise direction, until the detent 26 engages the lip at the outer rim of the lid channel. The user may feel the detent snap into place, and will also generally hear a "click" at this point. The handle is removed from the paint can by simply rotating the grip counter-clockwise as seen in FIG. 3, pulling the detent 26 off the outer rim of the paint can. The flexibility of the plastic material allows this rotation by further deforming the middle arm 22, without breaking the material.

A side elevation view of the handle is shown in FIG. 4. An elongated end 57 of the grip may also be formed into a pry tip for prying the lid from the paint can.

Second Embodiment

Figure 6:
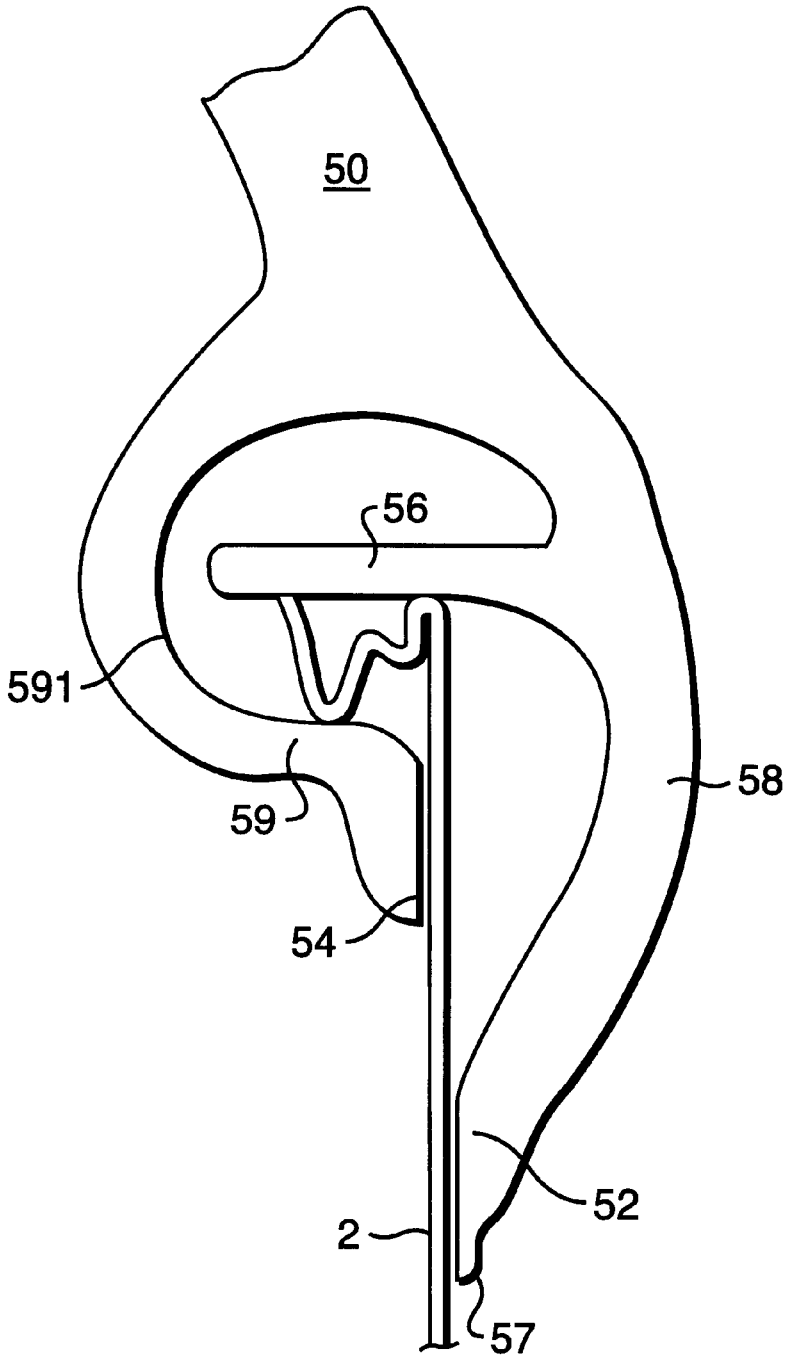
FIG. 6 depicts a side elevation view of an alternative version of the preferred embodiment of the invention.

A variation of the first embodiment is shown in side elevation view FIG. 6. The major difference between this embodiment and that of the first preferred embodiment is the lack of a detent in the embodiment. While the detent is generally optional, it is preferred to change the geometry slightly, so that middle arm 56 is in a substantially horizontal position when the handle is in place as attached securely to the paint can; in comparison, the first embodiment has its middle arm 22 at an acute angle relative to the plane of the top of the paint can. The vertical forces between middle arm 56 and upper arm 591 where it contacts lid channel 14 are substantially orthogonal to the horizontal stabilizing forces between the upper heel 54 and the lower heel 52, therefore the detent is less important. An upward, and countervailing force is transmitted through the lift point 59, located on the upper arm 591 in proximity to the upper heel 54. FIG. 6 further discloses a lid pry 57 at the lower end of lower arm 58.

Third Embodiment

Figure 5:
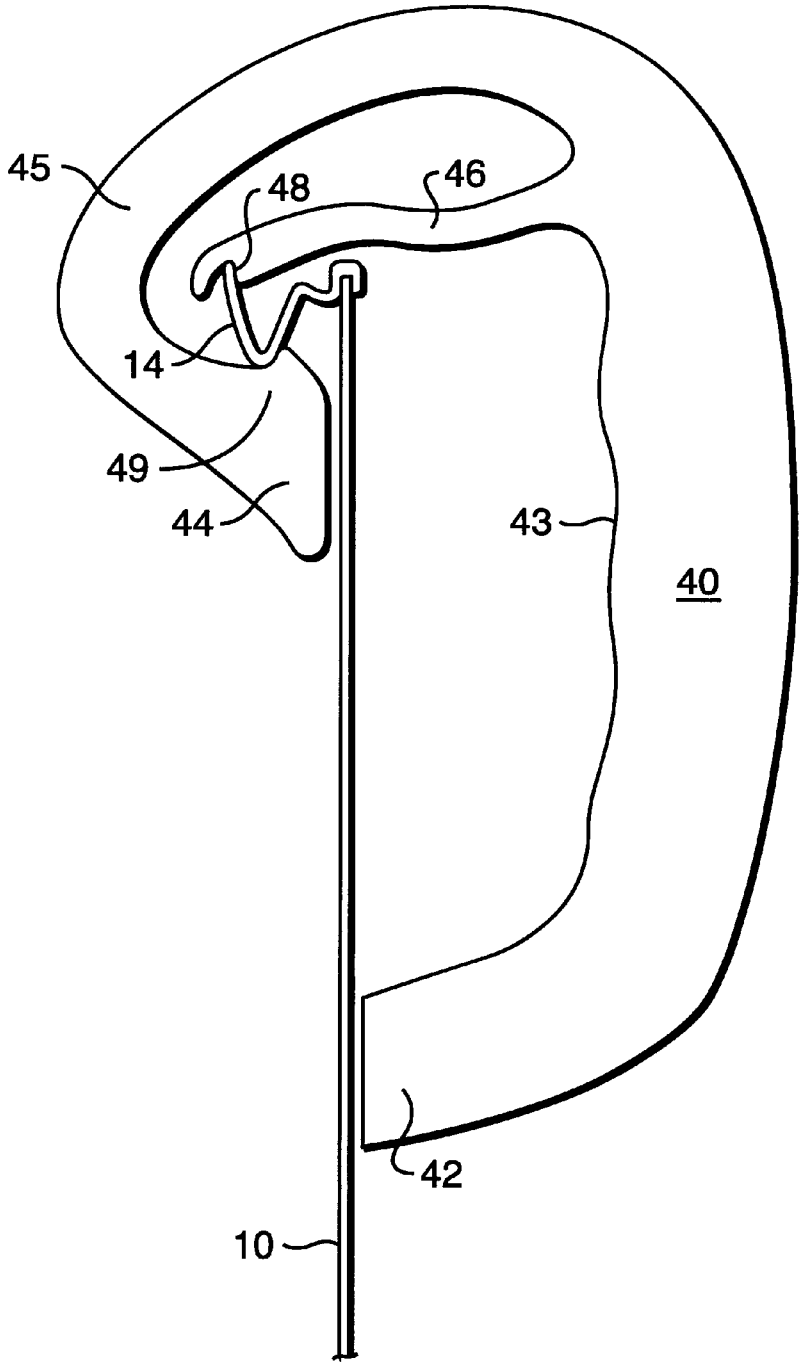
FIG. 5 depicts a side elevation view of a second alternative embodiment of the invention, having a handle to the side of the paint can.

A third embodiment is depicted in FIG. 5. The major difference in the embodiment of FIG. 5 from the previous embodiments is the location of the grip 43, from that of the previous embodiments. The grip in this case is along the side of the paint can, so that the body 40, is adjacent to, and substantially parallel to the paint can side wall 10. The third embodiment, like the previous two, provides horizontal stability by means of upper heel 44 and lower heel 42. Vertical stability is likewise provided by trapping the lid channel 14 between the detent 48, at the end of middle arm 46, and the lift point 49 located on the upper arm 45 in proximity to the upper heel 44, where the lift point contacts the bottom point of the lid channel.

Like the embodiment of FIG. 6, changing the geometry of this embodiment slightly can eliminate or change the location of the detent. The location of the grip at the side of the paint can makes the handling of the paint can more convenient under some circumstances: it makes tipping the can to access the paint easier when the can is almost empty. However, it does not allow for hanging of the paint can on a ladder. It also requires more strength to be exerted holding the can, which tends to rotate in the user's hand, while the first two embodiments require only a vertical force because of the location of the handle over the center of gravity of the paint can.

Figure 7:
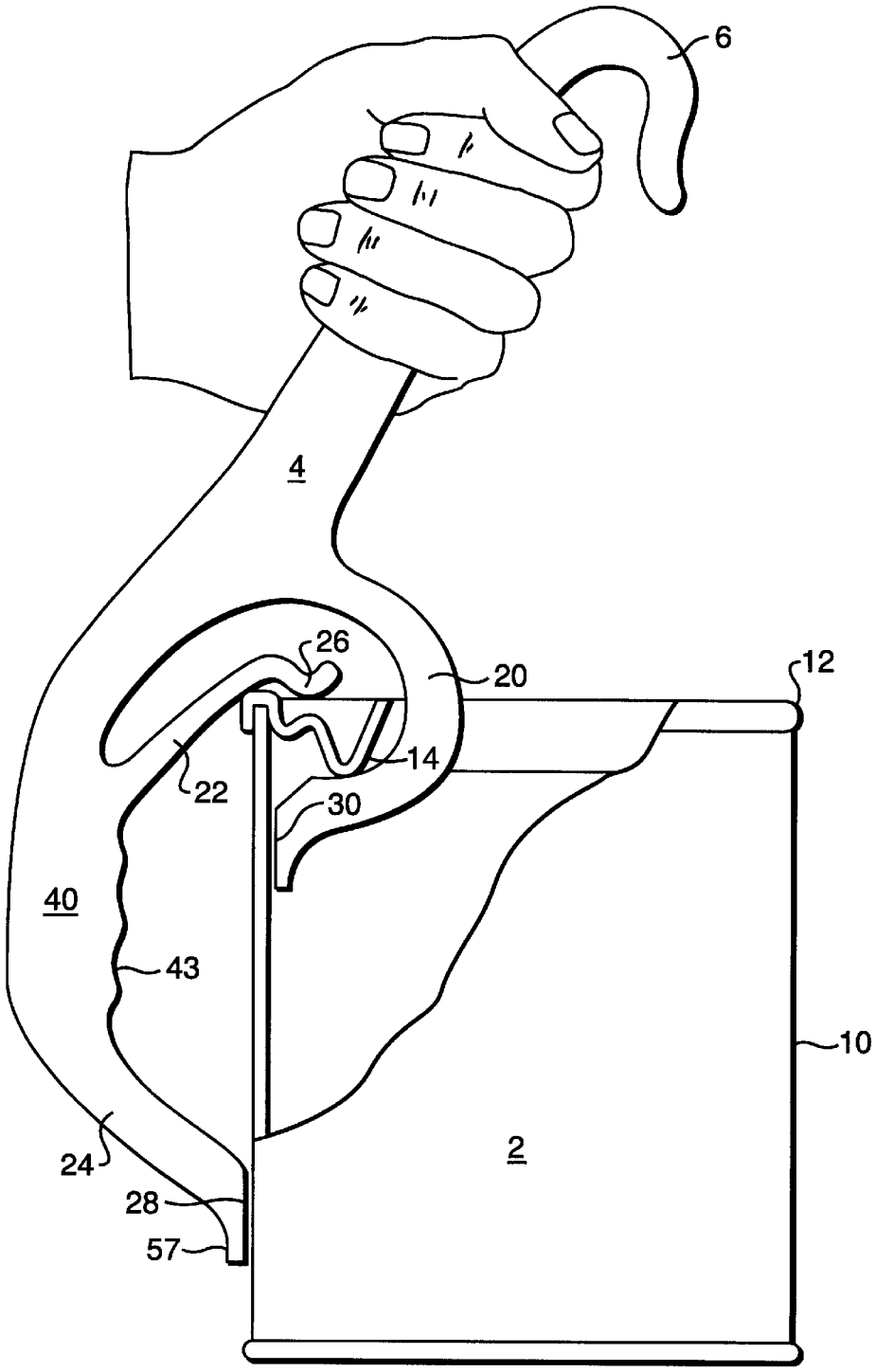
FIG. 7 depicts a side elevation view of the preferred embodiment of the invention, being held by the handle.

A final, and preferred embodiment may be understood by referring now to FIG. 7. This embodiment combines the advantages of the embodiments of FIGS. 4 and 5. The embodiment shown if FIG. 4 has an elongated body 4 which is extended upward in a direction that allows the user to grip it above the center of gravity of the paint can. In addition, a hooked upper end 6 can be used to temporarily attach the can to a ladder, or to a similar support so that the user need not constantly hold the can while painting.

FIG. 7 also contains a side grip 43 which allows the user to hold the can firmly when it is desired to hold the can and paint at the same time, and like the embodiment of FIG. 5, is more convenient when the paint is low in the can, and the can must be tipped. This preferred embodiment may be configured to contain virtually all the elements of the two above-mentioned embodiments, including, but not limited to the pry tip 57 of FIG. 4. This pry tip may be located in proximity to the hook 6 in this embodiment, as an alternative to the heel end 28.

As to the detent, it may be included or omitted in almost all of the embodiments shown. Being little more than an extra curve or dimple in the middle arm of the various embodiments (22,26,46,56) the detent is a cost-free feature, and provides positive feedback to the user that the handle has been affixed in place on the paint can. The detent typically provides a tactile and auditory "click" when it engages the rim of the paint can, so that the possibility of accidents is diminished thereby.

It will be apparent that improvements and modifications may be made within the purview of the invention without departing from the scope of the invention defined in the appended claims.

What is claimed is:

1. A detachable handle for lifting a container having a side wall, and farther comprising a lid-receiving channel at the top of the container, the handle integrally formed from compliant material, and comprising:

a) a tip;

b) upper-arm means to apply a force to a side wall of the container;

c) upper heel and lower heel means to prevent rotation of the container;

d) middle-arm means to secure the handle to the container; and e) a body to which the grip is affixed, all the said means integrally affixed to the body, so that the user may apply the lifting force through the vertical pressure applied to the handle.

2. The handle of claim 1, wherein the upper heel and lower heel means to prevent rotation of the container further comprises one or more heel members, one of which contacts an outside surface of a side wall of the container at a distance from the top of the container.

3. The handle of claim 2, wherein the upper-arm means to apply a lifting force further comprises a lift point which engages the bottom of the lid-receiving channel.

4. The handle of claim 3, wherein the middle arm further comprises a detent member which removeably engages the lid-receiving channel.

5. The handle of claim 4, where in the detent member further comprises a detent.

6. The handle of claim 5, wherein the handle further comprises a ladder hook.

7. The handle of claim 6, further comprising middle arm means to establish a center of rotation of the handle on the container.

8. The handle of claim 7, wherein the handle has a substantially uniform thickness.

9. A detachable handle for lifting a container having a side wall and further comprising a lid-receiving channel at the top of the container, the handle integrally formed from compliant material, and comprising:

a) a grip;

b) an upper heel contacting the container on an inside surface of the side wall at an upper position;

c) a lower heel contacting the container on an outside surface of the side wall at a lower position;

d) a lift point contacting a bottom of the lid-receiving channel;

e) a middle arm contacting a top of the lid-receiving channel above the lift point; and f) a body to which the grip, the upper heel, the lower heel, the lift point, and the middle arm are affixed, so that the container is constrained from rotating by the upper and lower heels; a pressure between the middle arm and the lift point provide vertical stability, and the user may apply an upward force through the vertical pressure applied to the handle, and acting on the container as a vertical force applied at the bottom of the lid-receiving channel.

10. The handle of claim 9, wherein the upper heel is formed from an upper arm integrated in the handle, and the lower heel is formed from a lower arm integrated in the handle.

11. The handle of claim 10, which further comprises a detent formed in the middle arm which engages a top of the lid-receiving channel.

12. The handle of claims 10 or 11, wherein the detent is above the container top when the handle is affixed to the container.

13. The handle of claim 12, wherein the lift point further comprises a portion of the upper arm.

14. The handle of claim 13, wherein the handle further comprises a ladder hook.

15. The handle of claim 14, wherein the handle has a substantially uniform thickness.

16. A detachable handle for lifting a container having a side wall comprising an outer surface and an inner surface, and further comprising a lid-receiving channel at the top of the container, the handle integrally formed from compliant material, and comprising:

a) an elongated body, extending above the container when the handle is removeably affixed to the container;

b) an upper arm, affixed to the elongated body;

c) an upper heel affixed to the upper arm, and contacting the container on an inside wall at an upper position;

d) a side grip, affixed to the elongated body, located in proximity to the side wall of the container and substantially parallel to said side wall, e) a lower arm, affixed to the side grip;

f) a lower heel, affixed to the lower arm, and contacting the container on an outside wall at a lower position than the upper heel;

g) a lift point, located on the upper arm, and contacting a bottom of the lid-receiving channel; and means to secure the lift point to the bottom lid of the receiving channel, so that the container is constrained from rotating by the upper and lower heels, and the user may apply an upward force through the vertical pressure applied to the handle at either the elongated body or the side grip, and acting on the container as a vertical force applied at the bottom of the lid-receiving channel.

17. The handle of claim 16, further comprising a middle arm, affixed in proximity to the side grip, and contacting the top of the lid-receiving channel above the lift point, so that the pressure between the middle arm and the lift point is created as a result, providing vertical stability.

18. The handle of claim 17, wherein the middle arm further comprises a detent.

* * * * *